United States Patent [19]

Förster et al.

[11] 4,128,126

[45] Dec. 5, 1978

[54] APPARATUS FOR SUPPORT OF SHEET-METAL-TYPE HEAT EXCHANGER MATRICES FOR RECUPERATIVE HEAT EXCHANGE

[75] Inventors: Siegfried Förster, Alsdorf; Manfred Kleemann, Quadrath, both of Germany

[73] Assignee: Kernforschungsanlage Jülich Gesellschaft m.beschränkter Haftung, Julich, Germany

[21] Appl. No.: 735,135

[22] Filed: Oct. 26, 1976

[30] Foreign Application Priority Data

Nov. 3, 1975 [DE] Fed. Rep. of Germany ..... 2549052

[51] Int. Cl.[2] ..... F28D 9/02

[52] U.S. Cl. ..... 165/165; 176/65

[58] Field of Search ..... 165/157, 166, 9, 8, 165/7, 5; 176/65

[56] References Cited

U.S. PATENT DOCUMENTS

| | | | |
|---|---|---|---|
| 2,576,213 | 11/1951 | Chausson | 165/157 |
| 2,757,907 | 8/1956 | Williams | 165/9 |
| 2,953,110 | 9/1960 | Etheridge | 165/157 |
| 3,106,957 | 10/1963 | Cannon | 165/157 |
| 3,266,568 | 8/1966 | Butt et al. | 165/166 |
| 3,780,800 | 12/1973 | Flower | 165/166 |
| 3,797,565 | 3/1974 | Fernandes | 165/166 |

*Primary Examiner*—Charles J. Myhre
*Assistant Examiner*—Theophil W. Streule, Jr.
*Attorney, Agent, or Firm*—Flynn & Frishauf

[57] ABSTRACT

Heat exchanger matrices of the folded strip type are set in an elongated V configuration inside a tubular casing. They are held in position by braces between opposite cover plates and between other cover plates and the casing, which braces also operate as partition walls for separating inlet and outlet channels of one of the media. The cooler of the media has inlet ducts downwards on the edges of the space inside the V and an outlet duct for upward flow at the center of the space inside the V. The other medium, which is hotter, but under less pressure, has inlet ducts with upward flow at the center of the spaces outside the V and outlet ducts with downward flow at the edges of the spaces outside the V. The hotter parts of the heat exchanger are in the middle of the structure. Bellows-type thermal expansion compensators seal the edges of the V against the casing.

8 Claims, 7 Drawing Figures

FIG. 4
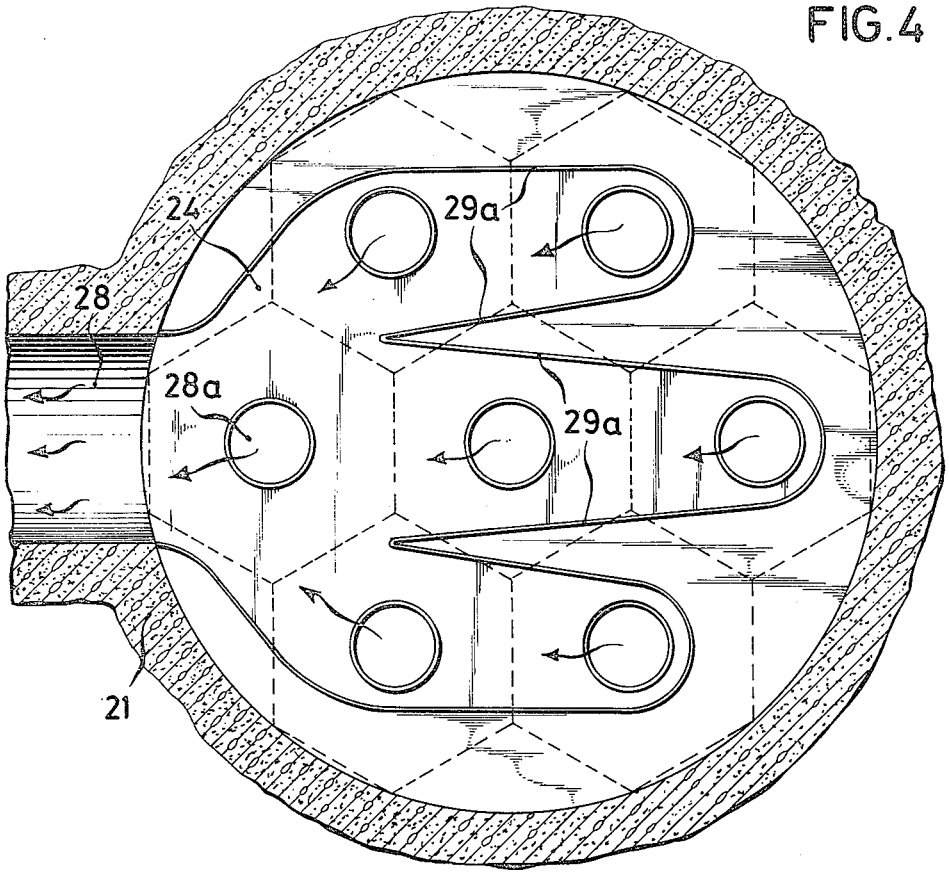
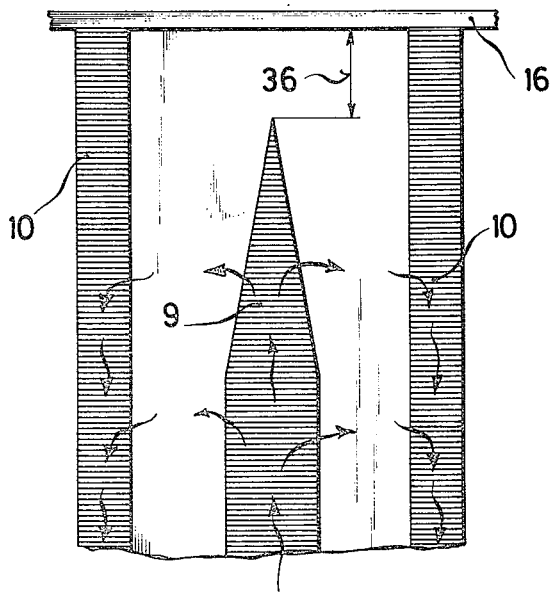
FIG. 7

APPARATUS FOR SUPPORT OF SHEET-METAL-TYPE HEAT EXCHANGER MATRICES FOR RECUPERATIVE HEAT EXCHANGE

This invention relates to apparatus for support of sheet-metal-type heat exchanger matrices that are constituted of uniformly repeated folds of a reciprocally folded strip, closed off at the ends of the folds and partially covered with cover plates touching the apices of the folds so as to define inlets and outlets to the fold chambers for the flowing heat exchanging media separated in heat-exchanging relation by the folded strips.

Heat exchanger matrices of this type are distinguished by a high capacity for heat transfer. In comparison with tube heat exchangers, they have a much smaller space requirement and also smaller weight for the same heat transfer capacity. It is therefore desired to employ sheet-metal-type heat exchangers even for large values of mass flow with high pressure and temperature differences between the media that are in heat-exchange relationship in the device. Because of their low bulk at high efficiency, sheet-metal-type heat exchange matrices are particularly well suited for heat transfer in energy central stations in which gas turbines are driven by a compressed working gas heated by high temperature nuclear reactors working in a closed gas work cycle. In such systems, such heat exchange matrices are important for recuperative heat exchange operations preventing heat energy from going to waste and from greatly thereby impairing the efficiency of the production of mechanical and ultimately electrical energy.

Heat exchangers of types heretofore known provided with sheet-metal heat exchange matrices do not allow an optimum utilization of the spaces that are provided for inserting the heat exchanger in prestressed concrete containers of the nuclear reactor installation. Thus, a heat exchanger is known from the disclosure of German Published Application(OS) No. 2,053,718 in which the sheet-metal heat exchanger matrix is quite narrowly enclosed in a flat casing, the space requirement of which, however, especially for high mass flow conditions, as occur in the case of high temperature nuclear reactor installations with a closed gas work cycle, are very large on account of the piping necessary to be provided for the parallel connection of heat exchanger units. It is also difficult to support such heat exchangers in the cavities of the prestressed concrete container.

In the case of elongated closed heat exchanger casings, such as are known from the disclosure of German Pat. No. 1,111,221, the casings must be reinforced or stiffened for high pressure and temperature differences between the media, so that the weight saving obtained by the utilization of sheet-metal-type heat exchanger matrices is offset and thereby lost to a considerable extent.

British Pat. No. 320,279 shows a high stiffness tubular casing for a heat exchanger matrix formed by the folds of a strip disposed in repeated back-and-forth folds. In this heat exchanger, however, there is the disadvantage of a high resistance to flow which must be accepted as part of the bargain in using this type of heat exchanger matrix. This last-mentioned heat exchanger is therefore not suited for heat exchange operations in the gas work cycle of a high temperature nuclear reactor. It is an object of the present invention to provide an apparatus for support of sheet-metal-type heat exchanger matrices which will make it possible to utilize such heat exchanger matrices for heat exchange in operations involving high mass flow and great temperature and pressure differences between the media that are in heat exchange relation in the matrices.

It is still a further object of the invention to provide such an apparatus that is of simple construction and that makes the heat exchanger matrices readily accessible and removable even after insertion in a prestressed concrete container of a nuclear reactor power plant.

SUMMARY OF THE INVENTION

Briefly, at least one pair of sheet-metal-type heat exchanger matrices of the kind referred to above are inserted in a tubular casing, connected in parallel and disposed on planes running from one end opening to the other of the casing, and partition walls are provided between the cover plates of such a pair that are disposed back to back for separating the inlet and outlet ducts for one of the media and, likewise, partitions are provided between the other cover plates of the pair of matrices and the inner wall surface of the casing for separating the inlet and outlet ducts of the other of the media. An end plate providing a flange for the casing is affixed to the casing at one end and fits on a fixed carrier framework that provides a plurality of honeycomb-like cells open at top and bottom on which a plurality of such casings are supportable by their respective end plates, which are conveniently polygonal, preferably in the shape of a regular hexagon, for making the most of the available space for support purposes. The carrier framework advantageously provides for holding a number of adjacent heat exchanger matrices for operation in parallel in a highly compact arrangement. In the event of breakdown of a heat exchanger matrix, the advantage is provided that the casing containing the defective matrix is readily removable from the carrier framework. This ready accessibility of the individual heat exchanger components is of great importance, particularly for heat exchangers that are interposed in the working gas cycle of high temperature nuclear reactor installations, because of the heavy loading of the heat exchanger matrix as the result of pressure and temperature differences between the media. Furthermore, the subdivision of the heat exchanger into a multiplicity of smaller units leads to a cost reduction in the manufacture of heat exchangers. The mounting of the sheet-metal-type heat exchanger matrices in tubular casings is particularly advantageous because of the higher stiffness of tubular casings compared to casings of square or rectangular cross-section.

In a further elaboration of the invention, the feature is provided that gas-tight thermal expansion compensators are provided to seal flexibly the gaps between the edges of the folded strip of each heat exchanger matrix and the casing. These thermal expansion compensators are advantageously designed to take up resiliently the thermal expansion of the heat exchanger matrices that takes place particularly lengthwise of the folds, which is to say crosswise of the strip. The honeycomb-like carrier framework preferably has an outer contour that is limited by a circumscribed circle and a cross-section in the plane of that circle providing seven cells each in the shape of a regular hexagon. This subdivision of space in the carrier framework is optimum for spaces such as are provided in the prestressed concrete containers providing for housing the heat exchangers in high temperature reactor installations.

In a further elaboration of the invention, the heat exchanger matrices of a pair are arranged in mutual mirror-image relation with respect to the direction of flow of the media within the heat exchanger matrices. In such a mirror-image arrangement of the heat exchanger matrices, the thermal expansions and the thermal stresses to which the heat exchanger matrices and casings are subjected compensate each other and reduce their net effect. A uniform flow through the heat exchanger matrices is obtained by disposing the heat exchanger matrices of a pair located in a common casing at an acute angle to each other and to the axis of the casing (which, in the usual case, bisects the first-mentioned acute angle). In this way the enclosed space through which the media flow and also the spaces between the respective heat exchanger matrices and the casing walls have a narrowing taper, as seen from the inlets of the unit and a broadening taper towards the outlets.

In order to keep as small as possible the resistances to flow of the heat exchanger matrices set in tubular casings, by a further elaboration of the invention, the flat surfaces of the folds of the folded strip of each of the heat exchanger matrices are at an angle substantially different from 90° with respect to the surfaces of the cover plates that touch the apices of those same folds.

The invention is further described by way of illustrative example with reference to the annexed drawings, in which:

FIG. 4 is a cross-section of the heat exchanger of FIG. 3 passing through the line IV—IV of FIG. 3;

Figure 6:
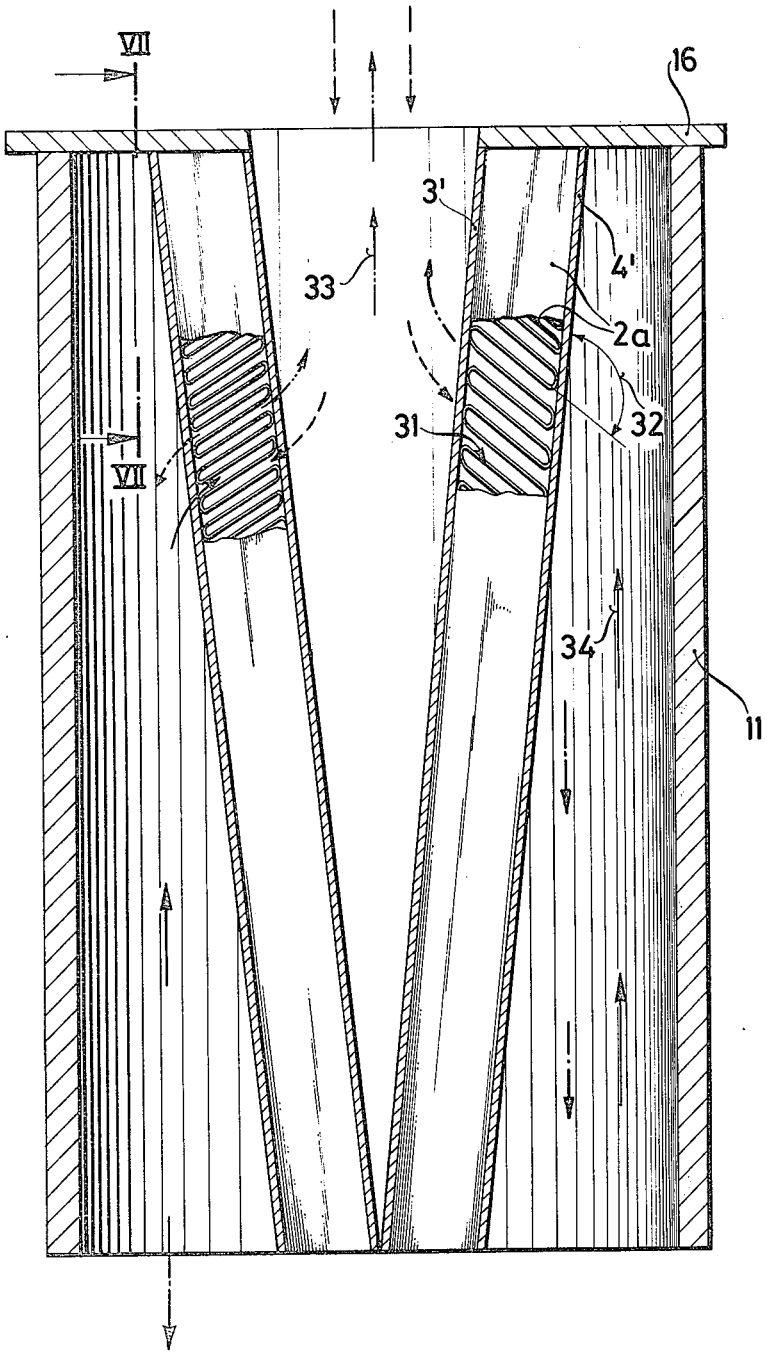

FIG. 6 is a longitudinal cross-section of a casing and heat exchanger matrices contained therein having the flat surfaces of the folds of the sheet-metal strips of the respective matrices at an angle substantially differing from 90° with respect to the adjacent color plates, and FIG. 7 is a detail view, in elevation, of a part of a heat exchanger matrix of FIG. 6 as seen from the section plane VII—VII of FIG. 6.

Figure 1:
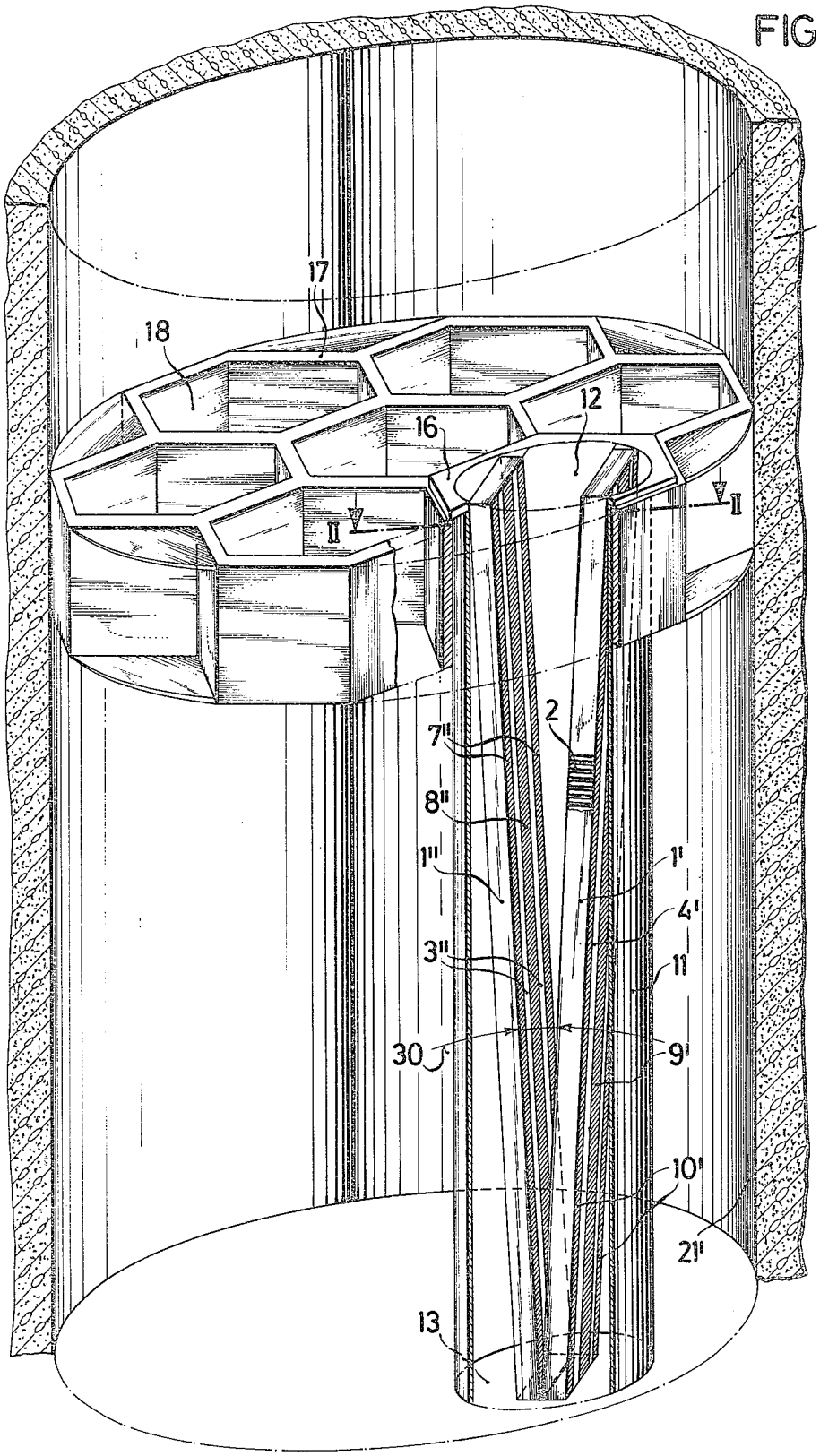
FIG. 1 is a perspective view, partly cut away, of a tubular casing containing heat exchanger matrices set into a honeycomb shape carrier framework.
Figure 2:
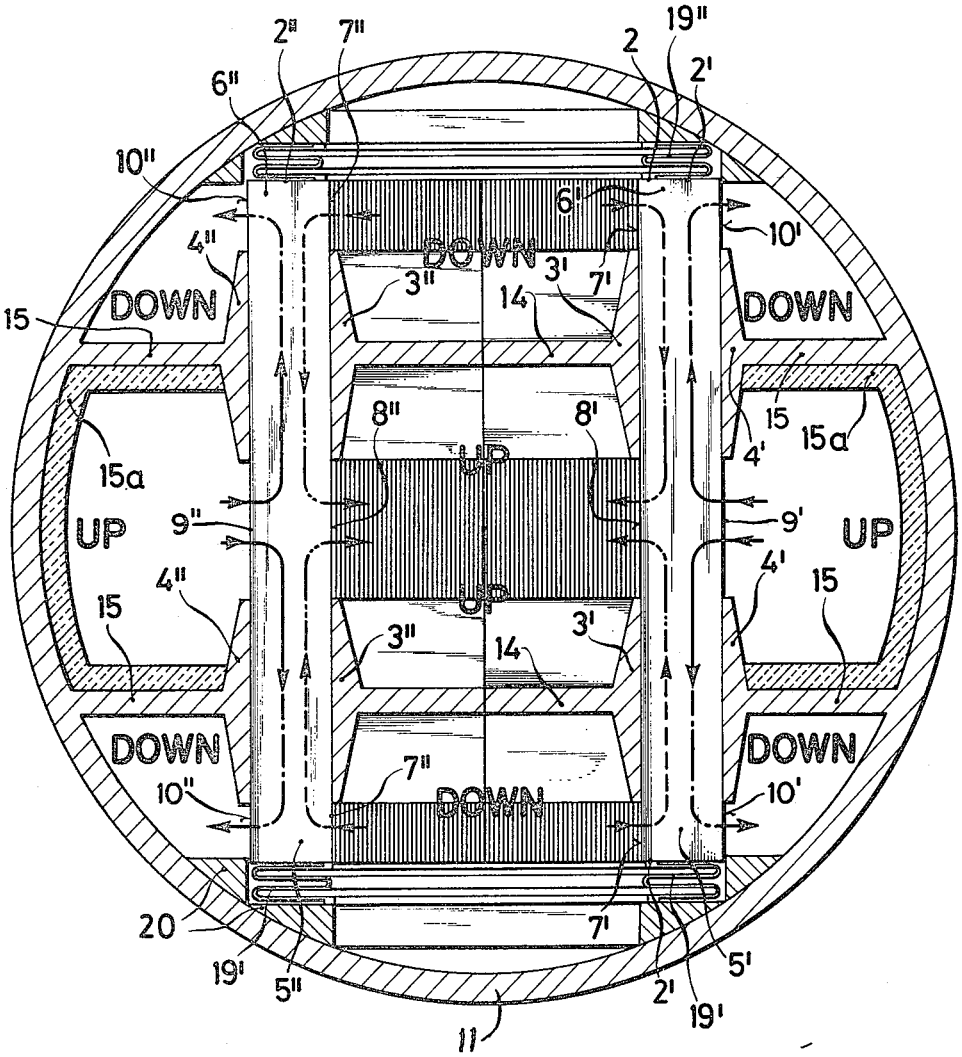
FIG. 2 is a cross-section through a tubular casing and its contents along the line II—II of FIG. 1.
Figure 3:
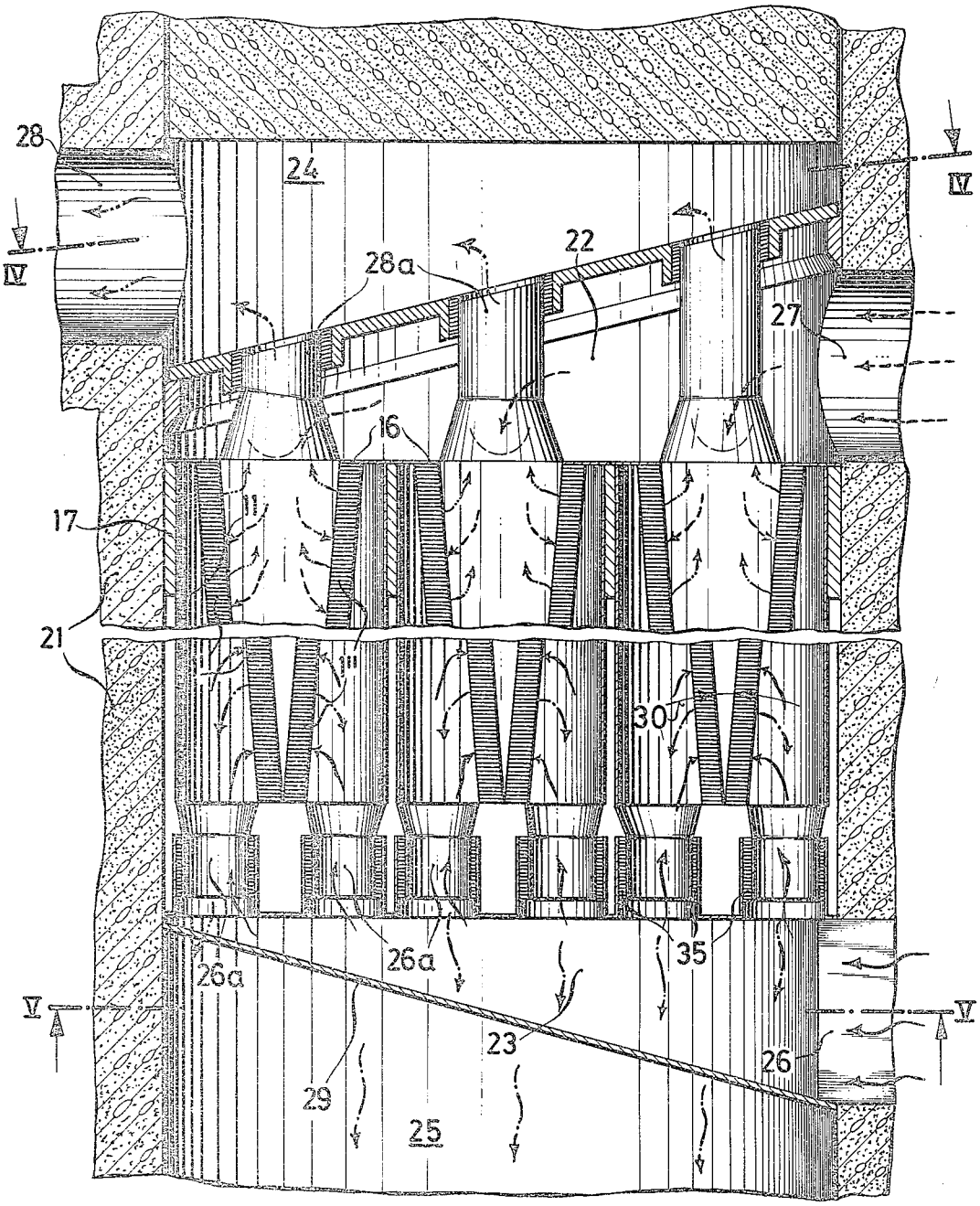
FIG. 3 is a longitudinal section through the middle of a heat exchanger equipped with a carrier framework and casings containing heat exchanger matrices in accordance with FIG. 1.

As shown particularly in FIGS. 1, 2 and 3, each of the sheet-metal-type heat exchanger matrices 1' and 1'', of which the arrangement and support is the object of the present invention, consists of a folded strip 2', 2'' that is closed off at the edges (at the ends of the folds) and having apices of the folds on the two sides of each matrix respectively covered in part by the cover plates 3', 4' in one case and 3'', 4'' in the other, in such a way that a multiplicity of chambers is formed between the cover plates and the strips on each side of the strip and, furthermore, inlets and outlets to these chambers are provided beyond the edges of the cover plates. The chambers on each side of the strip are traversed by parallel flow of one of the media. The inlets and outlets for the media in the illustrated example are located both in the end regions 5', 6', 5'', 6'' of the folds of the strips and also in the central region of the folds, so that each heat exchanger matrix carries the flow of each of the media in oppositely directed partial streams, as is indicated in FIG. 2 by the arrows drawn in for the purpose. In order that the path of flow of each of the media may be fully understood, in FIGS. 2, 3 and 6 the flow indicating arrows are differentiated to distinguish the two media and also to distinguish the inflowing and outflowing portions of the stream of each of the media. The medium which flows through the outer fold cavities of the two heat exchanger matrices shown in FIG. 2, which is preferably the hotter of the two media, has its inflow indicated by arrows shown in full lines and its outflow indicated by arrows shown in single-dot broken lines. The medium which flows through the inner fold cavities of the two matrices, which is preferably the medium under higher pressure, has its inflow designated by dashed line arrows and its outflow designated by double-dot broken line arrows. By having the media flow to or away from the centers of the folds in oppositely directed partial streams, as shown in FIG. 2, the substantially different thermal expansions of the respective cooler and hotter zones of the matrices, which occur especially in the case of high temperature differences, compensate each other in an advantageous way, which leads to a reduction of the thermal stresses to which the matrices are subject. Inlets 7', 9' and 7'', 9'' and outlets 8', 10' and 8'', 10'' of the respective matrices are so arranged that the media in the fold cavities in heat exchanging relation to each other flow countercurrent to each other and so that the hot zone is located in the mid regions of the respective folds of the respective matrices.

In order to support the folded strip heat exchanger matrices 1, 1'', a tubular casing 11 is provided in which the matrices are inserted and connected in parallel. The fold apex lines of the matrices are aligned in planes that extend between the end cross-sections 12 and 13 of the casing 11. The respective matrices have cover plates 3', 3'' oppositely adjacent to each other back-to-back near the center of the casing 11 and outside cover plates 4', 4'' respectively. Partition walls 14 are provided between each pair 3', 3'' of back-to-back cover plates to separate the inlet and outlet ducts of one of the media and partition walls 15 are, likewise, provided between the external cover plates 4' and the wall of the casing 11 and between the external plates 4'' and the wall of the casing 15 to separate the inlet and outlet ducts of the other medium. The partition walls 14 and 15 separate the respective inlet and outlet ducts in gas-tight fashion, of course. The inlet ducts communicate with the inlets 7', 7'', 9' and 9'' of the matrices respectively and the outlet ducts are similarly in communication with the outlets 8', 8'' and 10', 10'' of the matrices.

In addition to fulfilling this function of sealing off inlets from outlets, the partition walls 14 and 15 also function as support walls for the heat exchanger matrices. It is effective to provide heat insulation 15*a*, as shown in FIG. 2, on the inside of the inlet ducts that are preferred for the hotter of the media. The heat exchanger matrices are fastened in the tubular casings only at one of the ends of the casing, so that the matrices are free to expand towards the other end of the casing when they warm up.

At one end of the casing 11, the end 12 in the illustrated example, a polygonal end plate 16 is affixed forming a mounting or support for the casing. The casing 11 is supported by this end plate 16 by the load bearing fit of the end plate 16 against a fixed carrier framework 17 on which it rests. The carrier framework 17 has a number of honeycomb-like cells 18 open at top and bottom, each similar in outline to the polygonal contour of the end plate 16, in each of which a casing 11 can be hung substantially perpendicularly by its end plate flange resting on the framework. With perpendicular arrangement of the casings 11, it is not necessary to provide any additional fastening between the end plate 16 and the carrier framework 17, by screws, for example. This has the advantage that the casings 11 set into the carrier framework 17 are easily removable. The honeycomb form of the framework 17 provides sufficient stiffness to the framework to be able to withstand high stress loads. The framework 17 is set within the cylindrical walls enclosing the space provided for heat exchange as indicated in FIG. 1.

The heat exchange matrices 1' and 1" are supported laterally inside the casing 11 by thermal expansion compensators 19' and 19" shown in FIG. 2. The thermal expansion compensators 19' and 19" are on one side welded to the ends of the folded strips 2' and 2" of the matrices 1' and 1" respectively, and on the other side are welded each to a support member 20 that is affixed to the inner wall surface of the casing 11. The support elements 20 support the thermal expansion compensators 19' and 19" in such a way as to provide the advantage of relieving the weld seams at the ends of the folds of the strips 2' and 2" from the stresses that would occur if the ends of the folds, which is to say the edges of the folded strips, had to be sealed to the casing 11. These flexible mountings for compensating the effects of thermal expansion must, of course, seal the gaps between the matrices and the casing wall to keep the paths of the two media separate.

As shown in FIG. 1, the outer edge surfaces of the carrier framework 17 in that illustrated device lie on a circularly cylindrical surface within which the carrier structure forms seven cells 18 each having in the horizontal plane a regular hexagonal shape. This configuration has been found to be the optimum subdivision of the space for the provision of the carrier framework in cylindrical cavities, such as are provided for the housing of the heat exchangers in prestressed concrete containers for high temperature nuclear reactors. The heat exchanger matrices 1' and 1" are arranged in a reciprocally mirror-image configuration with reference to the direction of flow of the media inside the heat exchanger, so that heat stresses are thereby greatly reduced. The inlets 7' and 7" of the respective heat exchanger matrices in one tubular casing and the outlets 8' and 8" for one and the same medium are, accordingly, opposite each other.

In the case of the heat exchanger illustrated in FIG. 3, the carrier framework 17 is similarly fastened in a recess of a stress concrete container 21 for high temperature nuclear reactor installations. The interior spaces in the prestressed concrete container have a diameter of about 5 m. For a metal thickness of about 150 mm, the height dimension of the carrier framework 17 is about 2.5 m. The spaces enclosed by the walls of the prestressed concrete container 21 above and below the carrier framework 17 are utilized as gathering manifolds 22, 23, 24, 25 for the gases. For the purposes of this use of the spaces, however, the end plate 16 of the casing 11 are accordingly to be welded in a gastight manner to the carrier framework 17. This sacrifices the ready removability of individual casings 11.

Preferably, the casing 11 is so connected with inlet channels 26, 27 and outflow ducts 28 for the flowing media, that the medium which is under the higher pressure is supplied to and removed from the matrix at the end 12 of the casing 11, which is the end connected to the carrier framework 11. The effectiveness of the pressure seal between the casings 11 and the carrier framework 17 is thus provided. In the illustrated case, accordingly, the medium which is circulating under higher pressure is supplied through the gas gathering space 22 lying above the carrier framework 17 and after flowing through the heat exchanger matrices, this same medium is removed through the outlet channel 28. At the same time, the medium subjected to the lower amount of pressure is introduced in the lower gas-gathering chamber 23 and after flowing through the heat exchanger matrices, it is led away through the gas-gathering chamber 25. The outlet channel for the medium that is subjected to the lower pressure is not specifically shown in the drawing. For leading the media in their working paths, outlet channels 28*a* are located in the gas-gathering space 22 and in the gas-gathering space 23, there are the inlet channels 26*a*.

Figure 5:
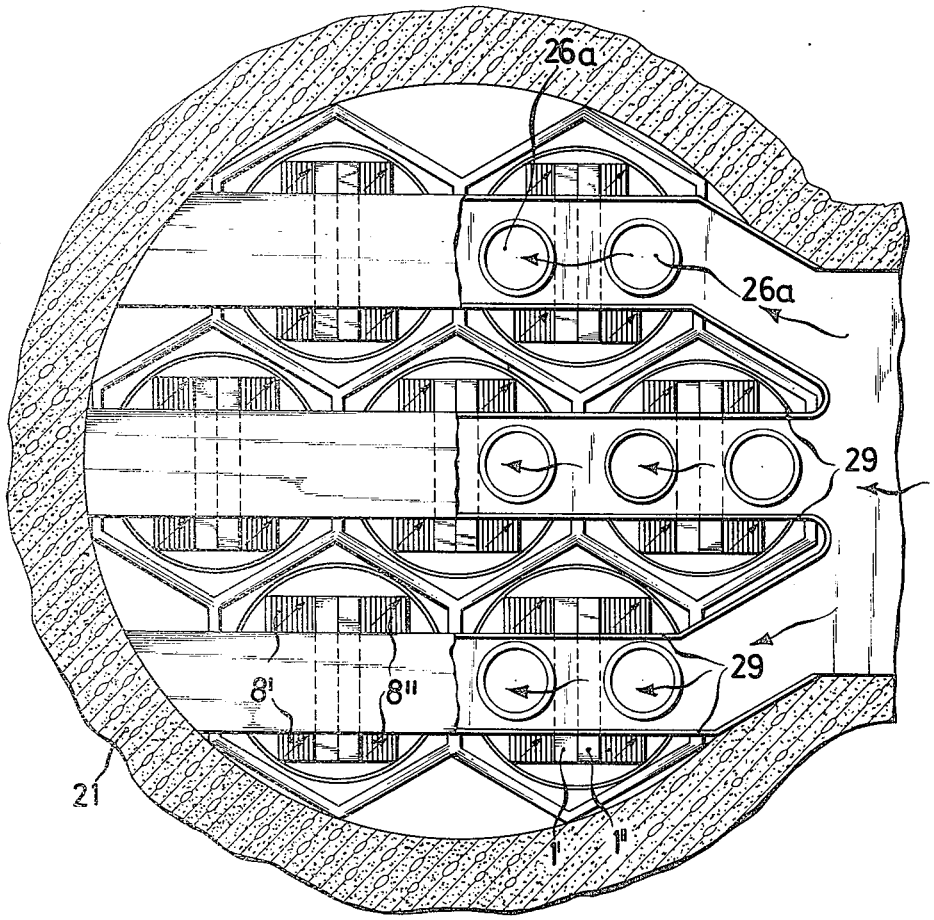
FIG. 5 is a cross-section of the heat exchanger of FIG. 3 passing through the line V—V of FIG. 3.

A particularly favorable form of construction of the gas-gathering chambers 23 and 24 respectively is shown in FIGS. 4 and 5. The outlet channels 28*a* and the inlet channels 26*a* communicate with the gas-gathering chambers which have changing flow cross-sections as seen in the direction of flow of the media, for the purpose of obtaining flow through the individual matrices which will be as uniform as possible. Thus, the gas-gathering space 24 widens in the direction of flow of the media and has a finger-like contour (FIG. 4) on account of the quantities of the media flowing out from the heat exchanger matrices. The partition wall 29 of the gas-gathering chamber 23 which serves to lead the medium which is under the lower amount of pressure to the heat exchanger matrices is constituted in such a form that, as seen in the direction of flow of the medium, wedge-shaped tapering chambers are provided which blend into the inlet channels 26*a* without any discontinuities of transition.

In order to obtain uniform flow through the heat exchanger matrices 1', 1", the heat exchanger matrices are inclined toward each other at an acute angle 30. In order to provide lateral sealing of these heat exchange matrices, a common thermal expansion compensator 19', 19" is provided (FIG. 2) preferably one on each side. A particularly advantageous form of the heat exchanger matrices, which leads to a lowering of the resistance to flow, is shown in FIG. 6. In the case of the heat exchanger matrices according to FIG. 6, the fold surfaces 31 of the folded band 2*a* are parallel and are disposed at an angle to the cover plates 3 and 4 of the folded strip 2*a* at an angle 32 substantially different from 90°.

In this organization and the corresponding disposition of the heat exchanger matrices in the casing, both the media which flow towards the matrices in the main flow direction 33 and those which flow out of the matrices with the main flow direction 34 are only slightly deflected from their respective paths, a feature that leads to very small pressure losses in the case of inflow and outflow.

The heat exchanger matrices 1' and 1" in the casing 11 are fastened only at the end 12 of the casing at which the end plates 16 are provided. At the end 13 labyrinth-type seals 35 are provided in the casing at the end 13 thereof (FIG. 3). The heat exchanger matrices can thus freely expand out in the casing 11 towards the end 13 thereof during the heat exchange operation. Temperature stresses at the end 12 of the casing 10 are, furthermore, also reduced by the fact that the inlets 9 of the heat exchanger matrix for the hotter medium run short of the end 12 of the casing 11 by a spacing 36 (FIG. 7), so that the heat exchanger matrix in the region of the end 12 of the casing receives flow only from the cooler medium and thus sets on this side of the heat exchanger matrix a gradual temperature rise from the end of the casing. This provision can be effectively supported by a gradual increase of the inlet width of the inlet 9a from its upper end, as seen from the end 12 of the casing.

Although the invention has been described with reference to a particular illustrative example, it is to be understood that variations are possible within the inventive concept. For example, if the heat exchanger is used for heat exchange between liquids, the compartmentation of course needs only to be liquid-tight, as distinguished from gas-tight and, for this reason, the expression "gas-tight" is to be understood as meaning tight to the extent necessary for the separation of the media in the particular case.

We claim:

1. In an apparatus supporting and including sheet-metal-type heat exchanger matrices that are constituted of uniformly repeated folds of reciprocally folded strips closed off at the ends of the folds formed by the strip edges and partially covered with first and second cover plates respectively touching the oppositely disposed apices of the folds that run across the strips, so as to define, by the portions of the matrices left uncovered, both inlets and outlets to the fold chambers for each of two flowing exchanging media that, in operation, are separated in heat-exchanging relation by said folded strips, said apparatus being capable of operation at high efficiency with substantial differences in the pressures of the respective media, the combination of:

a tubular casing (11);

at least one pair of said heat exchanger matrices (1', 1'') of said type connected in parallel, inserted in said tubular casing (11), aligned on planes extending from one end (12) to the other (13) of said casing (11), positioned in said casing so as to converge towards each other longitudinally at an acute angle and disposed in mirror image relation to each other with regard to the flow of the respective media into and out of the matrices;

first gas-tight duct-separating partitions (14) in said casing extending between back-to-back first cover plates (3', 3'') of the respective matrices of said pair of matrices, for separating from each other the inlet and outlet ducts for a first one of said media, said ducts respectively communicating with the fold chambers of each of said matrices by inlet portions (7', 7'') and outlet portions (8', 8'') of said matrices left uncovered by said first cover plates (3', 3'');

second gas-tight duct-separating partitions (15) in said casing respectively between second cover plates (4', 4'') of the matrices of said pair of matrices and said casing, for separating from each other the inlet and outlet ducts for the second of said media, said last-mentioned ducts respectively communicating with the fold chambers of each of said matrices by inlet portions (9', 9'') and outlet portions (10', 10'') of said matrices left uncovered by said second cover plates (4', 4'');

gas-tight thermal expansion compensation means (19', 19'') sealing gaps respectively between opposite edges of said strips (2', 2'') of said heat exchanger matrices (1', 1'') and opposite portions of the inner wall surface of said tubular casing (11);

an end plate (16) affixed to one end (12) of said casing (11) and providing an outwardly extending end flange for vertically suspending said casing on a carrier framework, said flange having a polygonal contour for anti-rotative locking with similar flanges of other similar tubular casings, and a carrier framework (17) mounted in fixed position in a massive hollow structure (21) and providing a plurality of honeycomb-like cells (18) each open at top and bottom on which a plurality of tubular casings, including said casing, are supportable in suspension by end plates like said end plate (16), said end plate being seated on said carrier and suspending said casing thereon in a position passing through one of said cells (18) and occupying and interfitting laterally snugly with end plates affixed to other tubular casings passing through other cells of said carrier.

2. A combination in an apparatus supporting sheet-metal-type heat exchanger matrices as defined in claim 1, in which said carrier framework (17) has a lateral contour fitting a circumscribed cylinder for mounting thereof in a cylindrical interior space of a prestressed concrete structure constituting said massive hollow structure and a cross-section in planes perpendicular to the axis of said cylinder forming seven of said honeycomb-like cells (18) each of which have a cross-section in the shape of a regular hexagon.

3. A combination in an apparatus supporting sheet-metal-type heat exchanger matrices as defined in claim 1, in which said folds of said folded strips, (2', 2'') of said respective matrices (1', 1'') are in large part constituted of parallel flat portions oriented at an angle (32) substantially different from 90° to the surfaces of said respective cover plates (3', 4'; 3'', 4'') that touch the respective apices of the folds of said respective strips.

4. A combination in an apparatus supporting sheet-metal-type heat exchanger matrices as defined in claim 1, in which said inlets (9) of said matrices for the hotter of said media are connected for supply of said hotter medium over a portion of the length of said matrices extending from the bottom end (13) of said casing upwardly towards said end plate only to a terminal point spaced (36) from said end plate (FIG. 7).

5. A combination in an apparatus supporting sheet-metal-type heat exchanger matrices as defined in claim 1, in which said pair of matrices are positioned in said casing so as to converge towards each other and to approach each other most closely at the bottom end (13) of said casing (11), the space between said matrices being also closed-off at the bottom of said casing, and in which each of the spaces between one of said matrices and the portion of said casing radially outwards therefrom is open at the bottom of said casing and closed-off at the top of said casing.

6. A combination in an apparatus supporting sheet-metal-type heat exchanger matrices as defined in claim 1, in which each of said first cover plates (3', 3'') is fixed with respect to one of said first partitions (14) and rests against fold apices, said strip (2) of one of said matrices (1', 1'') for firmly positioning said one of said matrices in said casing (11) without being affixed to said strip or said matrix, and in which, also, each of said second cover plates (4', 4'') is fixed with respect to one of said second partitions (15) and rests against fold apices of said strip (2) of one of said matrices (1', 1'') for firmly positioning said matrix in said casing (11) without being affixed to said strip or said matrix.

7. A combination in an apparatus supporting sheet-metal-type heat exchanger matrices as defined in claim 6, in which each of said first partitions (14) is fixed with respect to one first cover plate of each of said matrices and thereby contributes to positioning both of said matrices in said casing (11) at the same time that it provides a gas-tight partition between inlet and outlet ducts for said first medium.

8. A combination in an apparatus supporting sheet-metal-type heat exchanger matrices as defined in claim 7, in which each of said matrices is provided with two of said first cover plates and two of said second cover plates, and in which said inlets (9', 9'') for the hotter of said media are provided by openings between edges of two of said cover plates of the same matrix and in which said outlets (8', 8'') for the cooler of said media are provided between the edges of two of said cover plates of the same matrix, whereby the greatest heating of said matrices occurs in the longitudinal midportion of said strips of said matrices.

* * * * *